US009737096B2

(12) United States Patent
Hirakubo

(10) Patent No.: US 9,737,096 B2
(45) Date of Patent: Aug. 22, 2017

(54) CUP FOR BRASSIERE AND BRASSIERE AND METHOD FOR PRODUCING THE SAME

(71) Applicant: Gold Flag Ltd., Osaka (JP)

(72) Inventor: Akiyo Hirakubo, Osaka (JP)

(73) Assignee: GOLD FLAG LTD., Osaka (JP)

( * ) Notice: Subject to any disclaimer, the term of this patent is extended or adjusted under 35 U.S.C. 154(b) by 194 days.

(21) Appl. No.: 14/652,872

(22) PCT Filed: Feb. 8, 2013

(86) PCT No.: PCT/JP2013/000723
§ 371 (c)(1),
(2) Date: Jun. 17, 2015

(87) PCT Pub. No.: WO2014/122697
PCT Pub. Date: Aug. 14, 2014

(65) Prior Publication Data
US 2015/0320122 A1 Nov. 12, 2015

(51) Int. Cl.
*A41C 3/00* (2006.01)
*A41C 3/12* (2006.01)
(Continued)

(52) U.S. Cl.
CPC ..... *A41C 3/0021* (2013.01); *A41C 3/12* (2013.01); *A41C 3/14* (2013.01); *A41C 5/005* (2013.01)

(58) Field of Classification Search
CPC .. A41C 3/00; A41C 3/14; A41C 3/144; A41C 3/10; A41C 3/065; A41C 3/0021
(Continued)

(56) References Cited

U.S. PATENT DOCUMENTS 3,247,853 A * 4/1966 Sloate ..... A41C 3/10 450/55
3,384,091 A * 5/1968 Block ..... A41C 3/10 450/54
(Continued)

FOREIGN PATENT DOCUMENTS

JP H09-095807 4/1997
JP 2002-275707 9/2002
(Continued)

OTHER PUBLICATIONS

Office Action dated Oct. 1, 2015 from the corresponding Japanese application No. JP2013-528162.
(Continued)

*Primary Examiner* — Gloria Hale
(74) *Attorney, Agent, or Firm* — Lucas & Mercanti, LLP

(57) ABSTRACT

[Object] To provide a cup for a brassiere that is non-wired but can create not only a cleavage in the chest but also a beautiful decollete in the neckline area by pushing up the breasts.

[Solution] Provided is a cup 20 for a brassiere 10 obtained by molding a foam textile 1 into a cup shape. The cup 20 includes an upper breast holding face part 60 which covers an upper portion of a breast B and whose underarm-side end portion has a strap 50 attached thereto, a lower breast holding face part 70 which covers a lower portion of the breast B, and a sternum-side breast holding face part 80 which covers a sternum-side portion of the breast B. A rib 80*a* is formed on the inner face of the sternum-side breast holding face part 80.

9 Claims, 9 Drawing Sheets

(51) Int. Cl.
*A41C 3/14* (2006.01)
*A41C 5/00* (2006.01)

(58) Field of Classification Search
USPC ..... 450/38, 39, 54–57; 2/267, 268
See application file for complete search history.

(56) References Cited

U.S. PATENT DOCUMENTS 6,398,620 B1 * 6/2002 Huang ..... A41C 3/144 450/54
8,216,021 B1 * 7/2012 MacKinnon ..... A41C 3/10 450/54
8,221,189 B2 * 7/2012 Chen ..... A41C 3/065 450/54
2007/0049163 A1 * 3/2007 Lin ..... A41C 3/10 450/54
2010/0022163 A1 * 1/2010 Widell ..... A41C 3/144 450/39
2010/0041313 A1 * 2/2010 Castellano ..... A41C 3/144 450/39
2010/0267312 A1 * 10/2010 Chien ..... A41C 3/144 450/38
2010/0273395 A1 * 10/2010 Castellano ..... A41C 3/144 450/39
2010/0311307 A1 * 12/2010 Haworth ..... A41C 3/0021 450/57
2014/0154948 A1 * 6/2014 Yuasa ..... A41C 3/14 450/55

FOREIGN PATENT DOCUMENTS

JP 2006161246 A 6/2006
JP 2007070753 A 3/2007
JP 2009030203 A 2/2009
JP 3150793 U 6/2009
JP 3171826 U 11/2011
JP 4943965 B2 5/2012
JP 3180471 U 12/2012

OTHER PUBLICATIONS

Office Action dated Dec. 24, 2015 from the corresponding Japanese application No. JP2013-528162.
International Search Report dated Mar. 19, 2013 for Application No. PCT/JP2013/000723 and English translation.
Office Action dated Jun. 6, 2016 from corresponding Chinese Application; Total of 9 pages.

* cited by examiner (A)

(B)

CUP FOR BRASSIERE AND BRASSIERE AND METHOD FOR PRODUCING THE SAME

CROSS REFERENCE TO RELATED APPLICATION

This Application is a 371 of PCT/JP2013/000723 filed on Feb. 8, 2013, application which is incorporated herein by reference.

TECHNICAL FIELD

The present invention relates to a cup for a brassiere and a brassiere that can stably create an attractive cleavage between breasts and a beautiful decollete that appears more voluminous in the neckline area, and a method for producing them.

BACKGROUND ART

As conventional brassieres, there have been proposed brassieres that have a function of keeping the shape of breasts and a shape-correcting function of beautifully wrapping breasts with metal wires and the like (see Patent Literature 1, for example).

However, in recent years, it is in fashion, when wearing a brassiere, to form a beautiful bustline by slightly pulling up breasts accommodated in cups by means of the cups, and to create a cleavage due to two spherical breasts between the cups.

Thus, there have been elaborately developed brassieres whose cups themselves are improved such that an attractive cleavage appears. As an example of such an improved cup, there has been proposed a cup in which a total of three panels, i.e., an upper panel, a lower panel, and a sternum-side panel which form a cup, are sewed together to be integrated. Accordingly, when breasts accommodated in the cups are slightly pulled up by means of the cups, the breasts having been inwardly pushed are received by the sternum-side panels so as not to protrude to the sternum side, to create a cleavage between the cups, thereby forming a beautiful bustline (see Patent Literature 2, for example).

CITATION LIST

Patent Literature

[PTL 1] Japanese Laid-Open Patent Publication No. 2007-70753

[PTL 2] Japanese Patent No. 4943965

SUMMARY OF THE INVENTION

Problems to be Solved by the Invention

However, the sternum-side panels each have a thickness similar to the thickness of the outer two panels and greatly project by accommodating breasts that have been pulled up and inwardly pushed. As a result, although a deep cleavage may be formed, a beautiful decollete cannot be formed by pushing up the breasts. Moreover, in order to form a beautiful bustline, a hard wire is used for shape keeping. When such a wire is used in such a brassiere that pushes breasts inward and up, the wire bites into the skin of the wearer and gives discomfort to the wearer. Thus, recently, non-wired brassieres are preferred. However, in the case of non-wired brassieres, there also is a problem that the push-inward-up effect is not sufficient.

Further, also in terms of the production, in a cup obtained by sewing three panels together to be integrated, the seam lines appear externally, and thus, it is necessary to attach a cover cloth in order not to allow the seam lines appear externally. This also imposes a problem that the production steps become complicated.

Thus, an object of the present invention is to provide: a cup for a brassiere, the cup being non-wired hut able to create not only a cleavage in the chest but also a beautiful decollete in the neckline area by pushing up a breast; a brassiere using the cups; and a method for producing the brassiere that can simplify production steps and reduce costs.

Solution to the Problems

An invention according to claim 1 is characterized by "a cup 20 for a brassiere 10, the cup 20 being obtained by molding a foam textile 1 into a cup shape, the cup 20 including:

an upper breast holding face part 60 which covers an upper portion of a breast B and whose underarm-side end portion has a strap 50 attached thereto;

a lower breast holding face part 70 which covers a lower portion of the breast B; and a sternum-side breast holding face part 80 which covers a sternum-side portion of the breast B, wherein a rib 80*a* is formed on an inner face of the sternum-side breast holding face part 80."

The invention according to claim 2 is characterized in that "a top-surrounding portion 20*a* around a top of the cup 20, the top being a most-elevated portion in the cup, is caused to have a foam density higher than a foam density of an outer periphery portion 20*b* of the cup 20, so as to be a high-stretch portion, each of an outer periphery portion 20*b*, in the cup 20, of the sternum-side breast holding face part 80, a lower edge portion 24 of the lower breast holding face part 70, and a strap attachment portion 60*a* of the upper breast holding face part 60 is caused to have a lowest foam density, so as to be a non-stretch portion that is flexible but hardly stretches, and an upper edge portion 61 of the upper breast holding face part 60 is caused to have a foam density higher than the foam density of each non-stretch portion and lower than the foam density of the high-stretch portion, such that the upper edge portion 61 has stretchability that is intermediate between stretchability of the high-stretch portion and stretchability of the non-stretch portion" in the cup 20 for the brassiere 10 according to claim 1.

The invention according to claim 3 is characterized in that "at least one of the upper breast holding face part 60, the lower breast holding face part 70, and the sternum-side breast holding face part 80 has a large number of air holes 25 perforated therein, and a foam textile 1 used as the sternum-side breast holding face part 80 is harder than a foam textile used as the upper breast holding face part 60 and a foam textile used as the lower breast holding face part 70" in the cup 20 for the brassiere 10 according to claim 1 or 2.

The invention according to claim 4 is characterized in that "boundary lines 21*a* and 21*b* among the three types of breast holding face parts 60, 70, and 80 are made to be concave lines on an inner face side of the cup 20, and are caused to have foam densities lower than the foam density of the high-stretch portion" in the cup 20 for the brassiere 10 according to any one of claims 1 to 3.

The brassiere 10 of the invention according to claim 5 is characterized by "a brassiere using the cup 20 for the brassiere 10 according to any one of claims 1 to 4 as a pair of left and right cups of the brassiere, wherein each of the pair of left and right cups 20 is free at an inner edge 81 thereof being on a sternum side, both cups 20 are coupled together with a coupling tape 30, along lower edge portions 24 of the cups 20, side panels 40 respectively extend from underarm-side edges of both cups 20, and a pair of left and right straps 50 are respectively connected between the strap attachment portions 60*a* of both cups 20 and the side panels 40."

The invention of a method for producing the cup 10 according to claim 6 is characterized by the method including:

cutting a foam textile 1 to form a cup textile 2; and molding the cup textile 2, wherein a top-surrounding portion 20*a* around a top of the cup 20, the top being a most-elevated portion in the cup, is caused to have a foam density higher than a foam density of an outer periphery portion 20*b* of the cup 20, so as to be a high-stretch portion, each of an outer periphery portion 20*b*, in the cup 20, of a sternum-side breast holding face part 80, a lower edge portion 24 of a lower breast holding face part 70, and a strap attachment portion 60*a* of an upper breast holding face part 60 is caused to have a lowest foam density, so as to be a non-stretch portion that is flexible but hardly stretches, an upper edge portion 61 of the upper breast holding face part 60 is caused to have a foam density higher than the foam density of each non-stretch portion and lower than the foam density of the high-stretch portion, such that the upper edge portion 61 has stretchability that is intermediate between stretchability of the high-stretch portion and stretchability of the non-stretch portion, and a rib 80*a* is formed on an inner face of the sternum-side breast holding face part 80.

The invention of a method for producing the cup 10 according to claim 7 is characterized by the method including:

cutting a foam textile 1 to separately form a piece 60 for an upper breast holding face part which covers an upper portion of a breast B and whose underarm-side end portion has a strap 50 attached thereto, a piece 70 for a lower breast holding face part which covers a lower portion of the breast B, and a piece 80 for a sternum-side breast holding face part which covers a sternum-side portion of the breast B;

forming a cup textile 2 by seaming or bonding the pieces 60, 70, and 80 together;

subjecting the cup textile 2 to primary molding wherein a top-surrounding portion 20*a* around a top of the cup 20, the top being a most-elevated portion in the cup, is caused to have a foam density higher than a foam density of an outer periphery portion 20*b* of the cup 20, so as to be a high-stretch portion, each of an outer periphery portion 20*b*, in the cup 20, of the sternum-side breast holding face part 80, a lower edge portion 24 of the lower breast holding face part 70, and a strap attachment portion 60*a* of the upper breast holding face part 60 is caused to have a lowest foam density, so as to be a non-stretch portion that is flexible but hardly stretches, an upper edge portion 61 of the upper breast holding face part 60 is caused to have a foam density higher than the foam density of each non-stretch portion and lower than the foam density of the high-stretch portion, such that the upper edge portion 61 has stretchability that is intermediate between stretchability of the high-stretch portion and stretchability of the non-stretch portion, and a rib 80*a* is formed on an inner face of the sternum-side breast holding face part 80; and performing secondary molding by arranging a dressing foam textile 3 on an outer face of a primary molded article M1, to attach the dressing foam textile 3 to the outer face of the primary molded article M1 (FIG. 5).

Advantageous Effects of the Invention

In the invention according to claim 1, since the rib 80*a* is formed on the inner face of the sternum-side breast holding face part 80, the breasts B pulled up by the straps 50 and pushed inwardly from the outer side are pushed up by the volume-formed rib 80*a*, thereby forming a beautiful decollete in the neckline area.

Here, each of the upper breast holding face part 60, the lower breast holding face part 70, and the sternum-side breast holding face part 80 may be formed by being cut out of one sheet of the foam textile 1, or alternatively, foam textiles 1 having different hardnesses or thicknesses may be selected to be used as the upper breast holding face part 60, the lower breast holding face part 70, and the sternum-side breast holding face part 80, respectively. In the latter case, preferably, the foam textiles 1 are used such that that the hardness or the thickness of the sternum-side breast holding face part 80 is greater than the hardnesses or the thicknesses of the upper breast holding face part 60 and the lower breast holding face part 70. Each foam textile 1 is not limited to a particular one as long as it is appropriate to be used as a material for the brassiere 10. In general, foamed polyurethane having a cloth attached to one face thereof is used.

Further, the upper breast holding face part 60, the lower breast holding face part 70, and the sternum-side breast holding face part 80 are configured to be formed as one piece, and the one piece may be cut out of one sheet of the foam textile 1. In this case, since the rib 80*a* is formed on the inner face of the sternum-side breast holding face part 80, the foam textile 1 that is thick is preferably used.

In the invention according to claim 2, in a case where the cups 20 are used in the brassiere 10 in which the sternum portions are free as shown in FIG. 4, since the lower edge portion 24 of the lower breast holding face part 70 is a non-stretch portion that is flexible but hardly stretches, wires conventionally used in these portions can be eliminated. Moreover, the outer periphery portion 20*b*, in the cup 20, of the sternum-side breast holding face part 80, and the strap attachment portion 60*a* of the upper breast holding face part 60 are non-stretch portions which are flexible but hardly stretch. Accordingly, in a case where the strap attachment portions 60*a* are pulled up when the brassiere 10 is worn, and the breasts B are palled up to be pushed toward the sternum side by the lower edge portions 24 of the lower breast holding face parts 70 which hardly stretch, the pushed breasts B are wrapped in good shapes in the top-surrounding portions 20*a* rich in stretchability, are stably held by the ribs 80*a* of the sternum-side breast holding face parts 80 which hardly stretch, and thus, do not protrude out of those parts. As a result, a deep and beautiful cleavage is formed in the sternum area, and the breasts B are pushed up by the ribs 80*a*, whereby a beautiful decollete is formed in the neckline area.

In the invention according to claim 3, at least one of the upper breast holding face part 60, the lower breast holding face part 70, and the sternum-side breast holding face part 80 has a large number of air holes 25 perforated therein. Thus, each cup 20 is excellent in air permeability, and does not get stuffy. Further, since a foam textile used as the sternum-side breast holding face part 80 is harder than a foam textile used as the upper breast holding face part 60 and a foam textile used as the lower breast holding face part 70, the rib 80*a* does not yield under the pressure from the breast B inwardly pushed, and can effectively push up the inwardly pushed breast B.

In the invention according to claim 4, the boundary lines 21*a* and 21*b* among the three types of breast holding face parts 60, 70, and 80 are made to be concave lines on the inner face side of the cup 20, and are caused to have foam densities lower than the foam density of the high-stretch portion. Thus, these lines serve as reinforcing lines for the high-stretch portion. As a result, the top-surrounding portion 20*a* being the high-stretch portion does not unnecessarily project under the pressure from the breast B accommodated in the cup 20, and thus, a good-shaped breast B can be formed.

Figure 5:
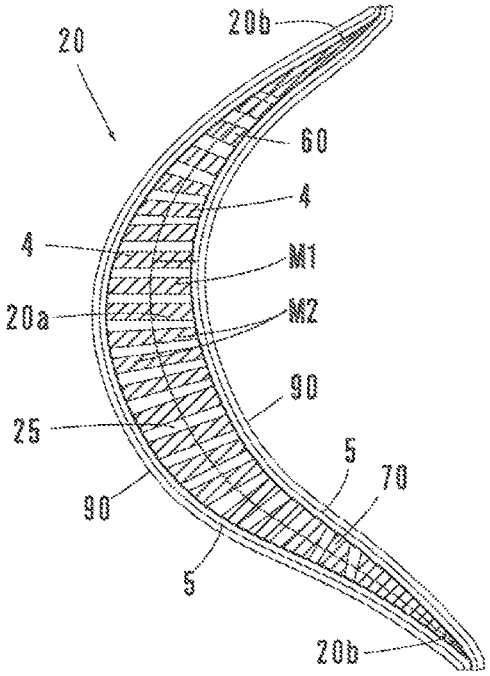
Figure 5:
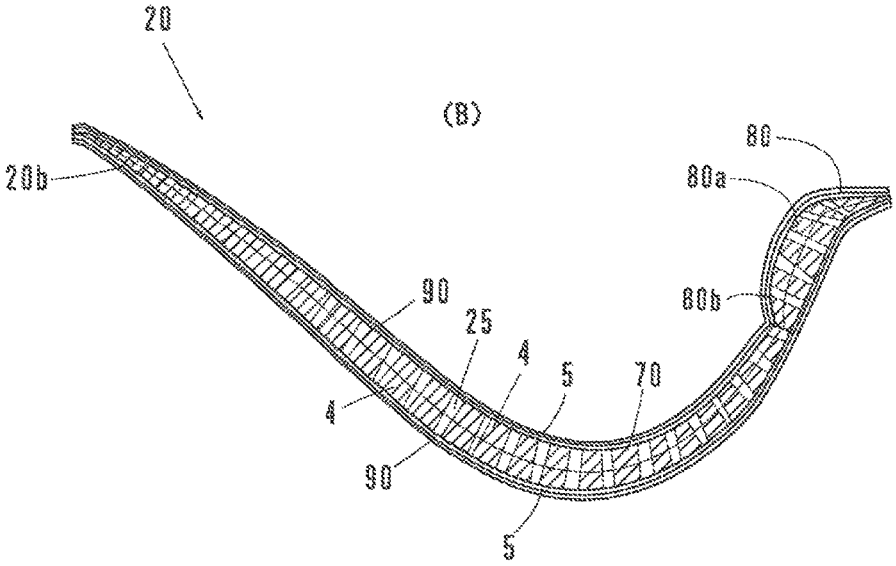

(A) of FIG. 5 is a vertical cross-sectional view of the cup of the present invention, and (B) of FIG. 5 is a horizontal cross-sectional view of the cup of the present invention.

Figure 6:
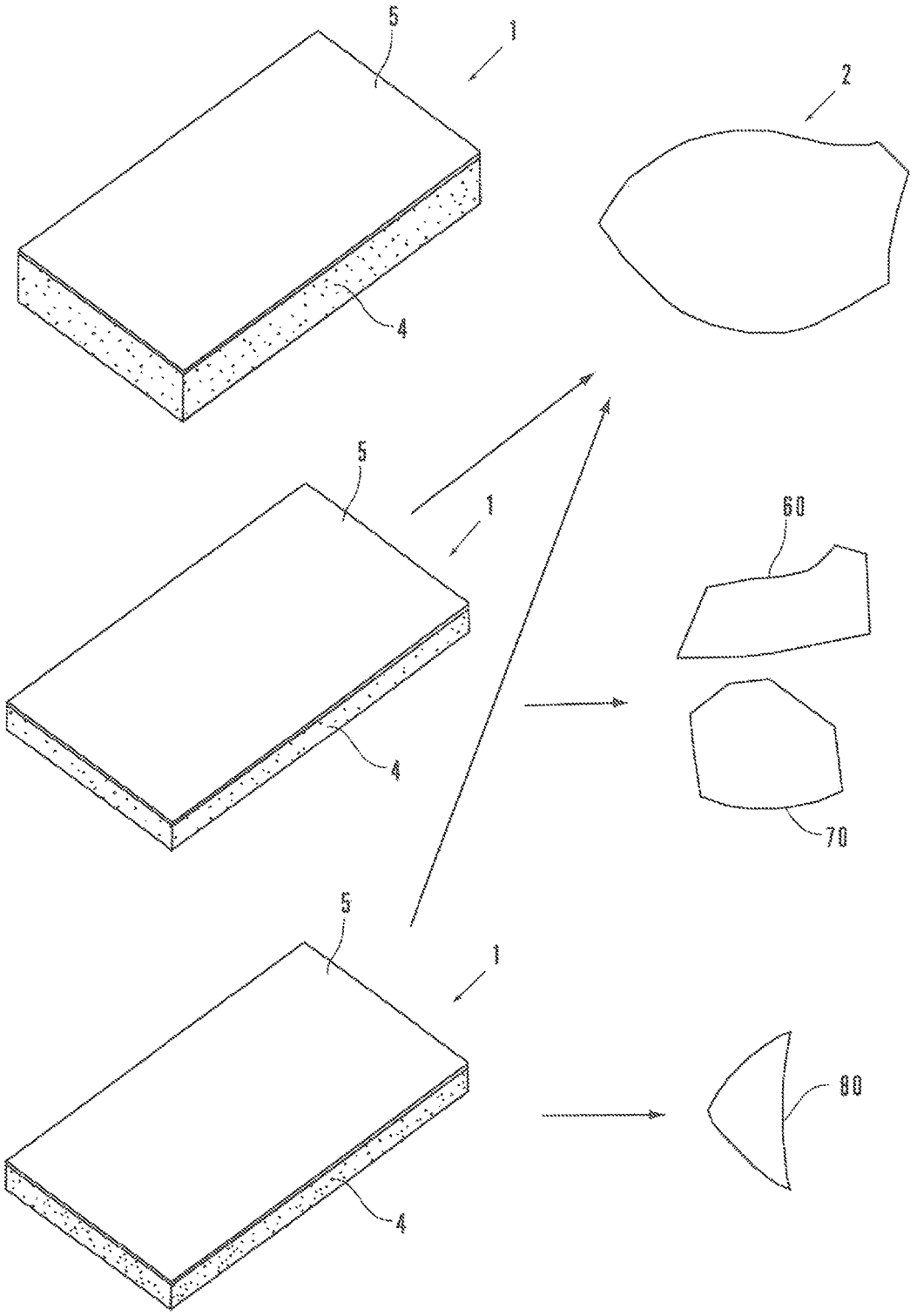

FIG. 6 shows how the cup of the present invention is cut.

Figure 7:
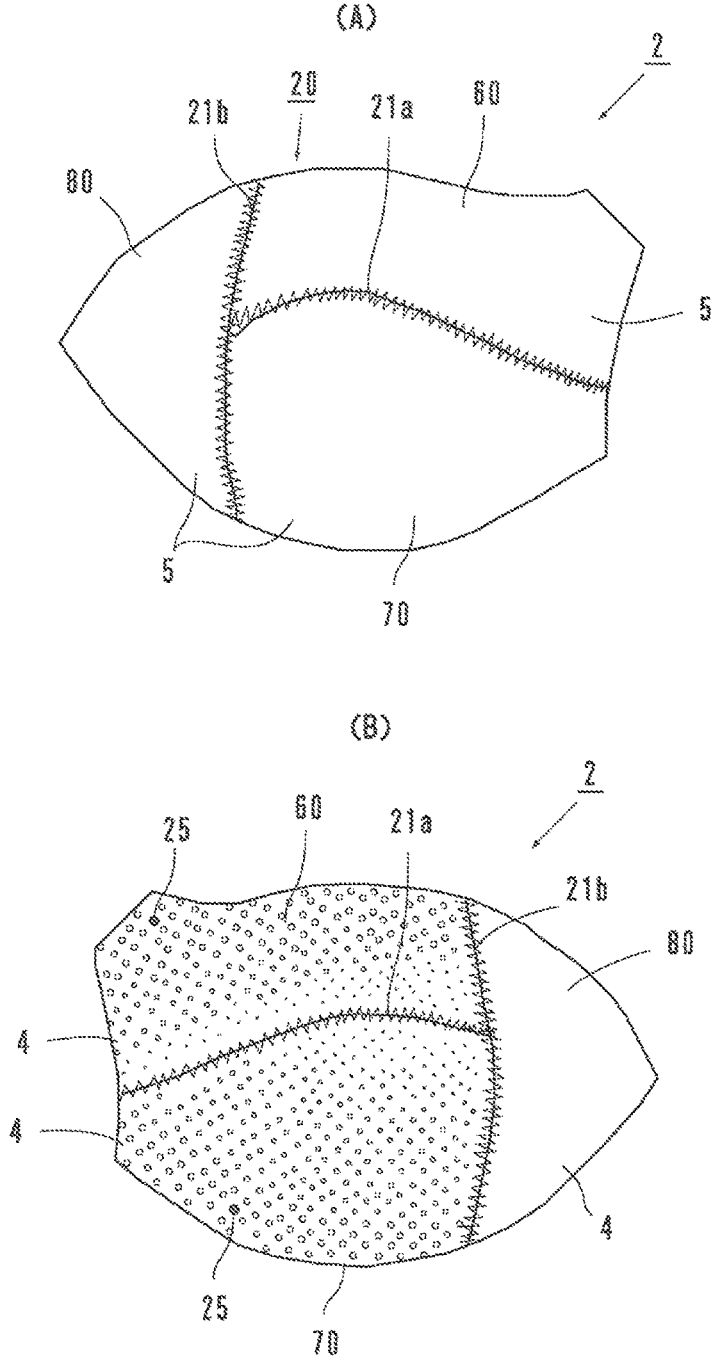

(A) of FIG. 7 is a front view of a seamed cup of the present invention, and (B) of FIG. 7 is a rear face thereof.

Figure 8:
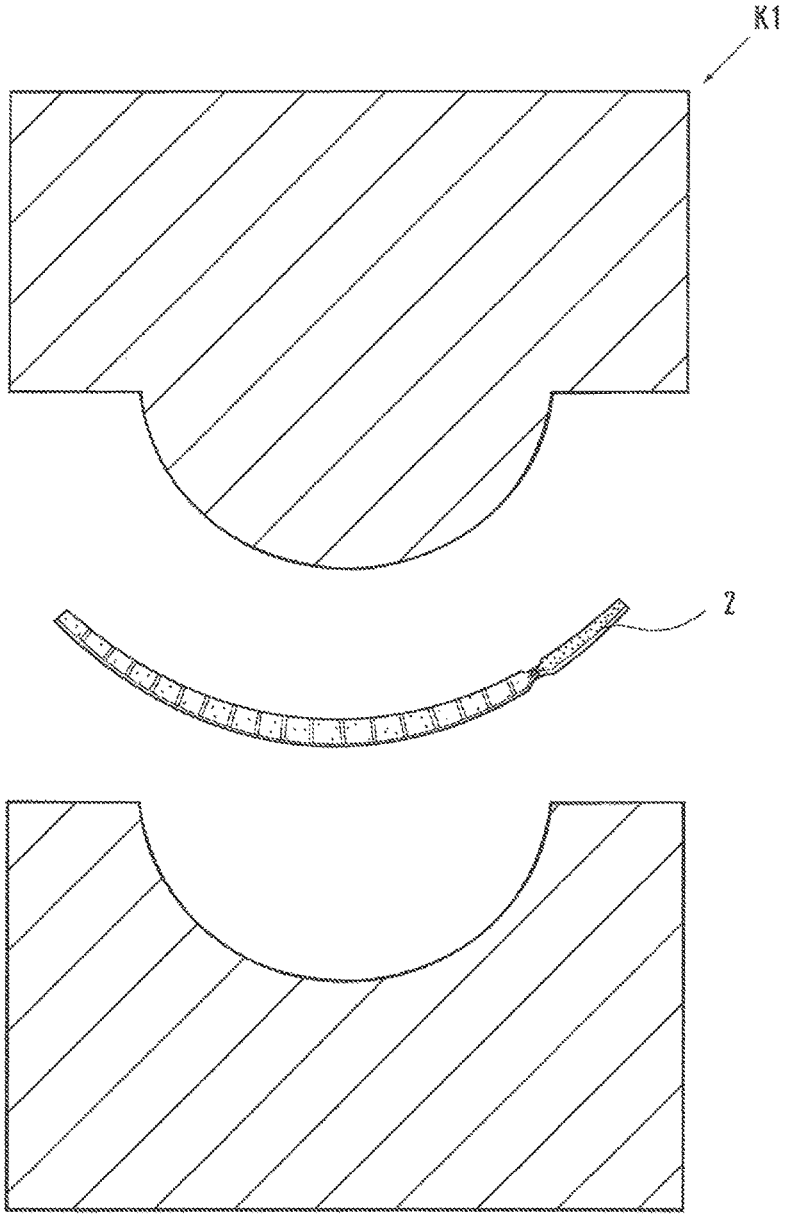

FIG. 8 is a cross-sectional view showing how the seamed cup shown in FIG. 7 is molded.

Figure 9:
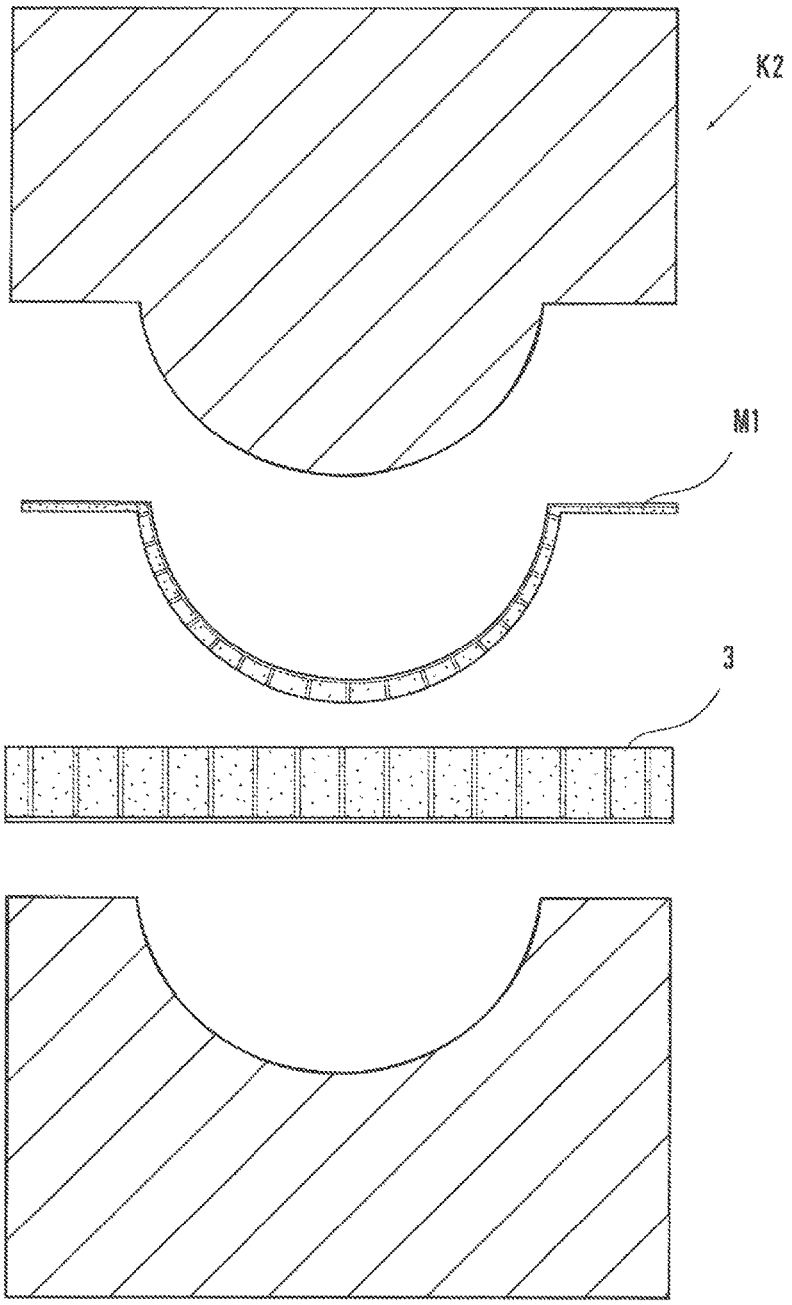

FIG. 9 is a cross-sectional view showing how the molded seamed cup shown in FIG. 8 and a foam textile is further molded together.

DESCRIPTION OF EMBODIMENTS

Figure 1:
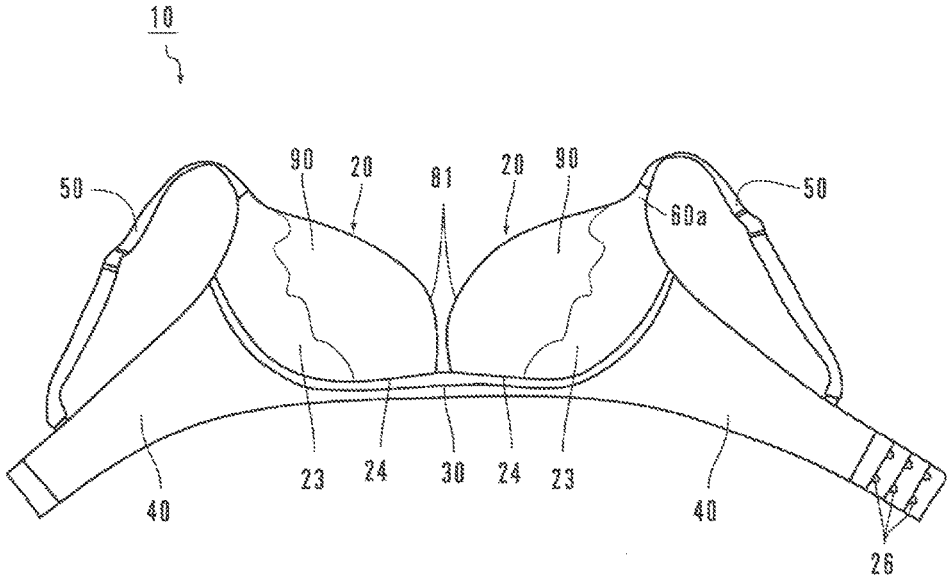
FIG. 1 is a front view showing a brassiere to which cups of the present invention are applied.
Figure 2:
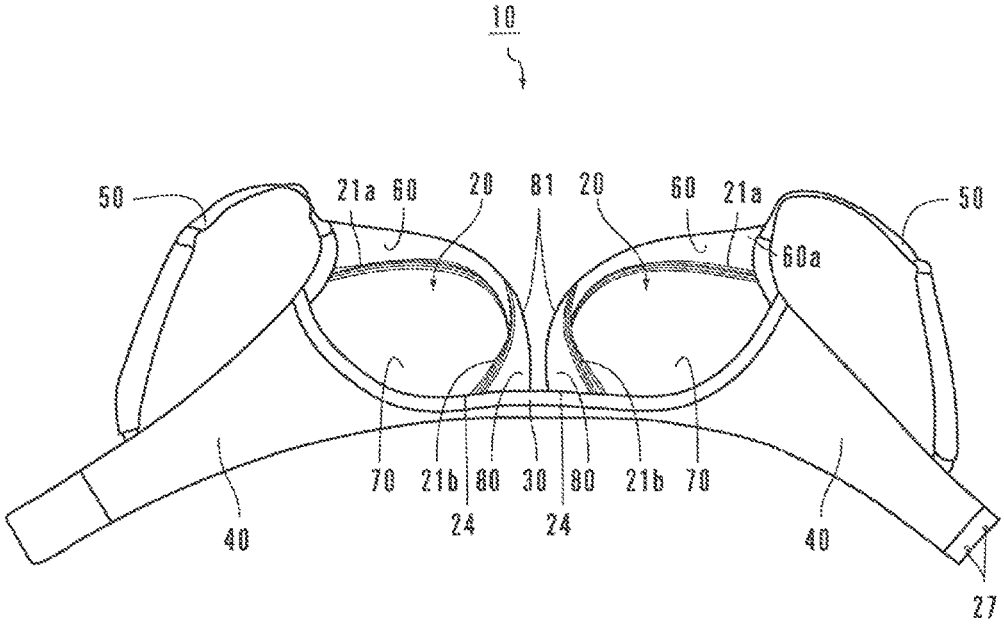
FIG. 2 is a rear view showing a brassiere to which the cups of the present invention are applied.

Hereinafter, the present invention will be described with reference to the drawings. As shown in FIG. 1 to FIG. 2, a brassiere 10 to which the present invention has been applied is mainly composed of a pair of left and right cups 20, a coupling tape 30 which couples the pair of left and right cups 20 together, side panels 40 which respectively extend from underarm-side end portions of the cups 20, and straps 50.

Figure 3:
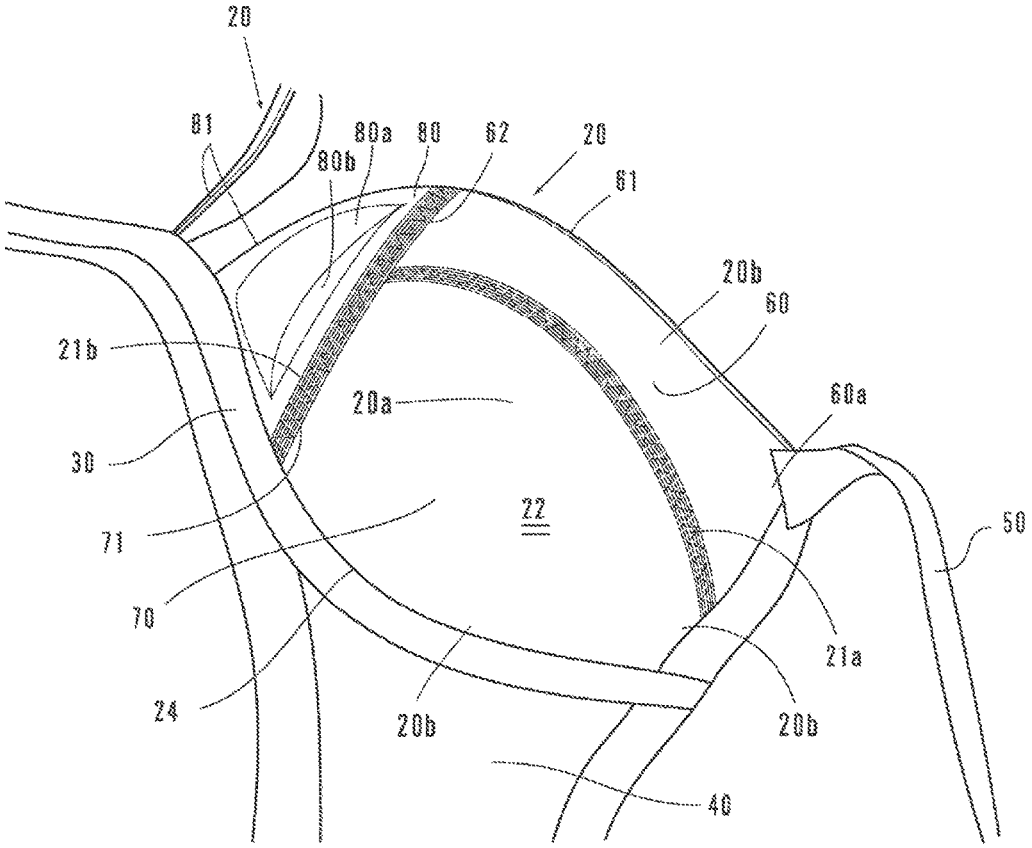
FIG. 3 is an enlarged perspective view showing a main part of the rear face of the cup of the present invention.

Each cup 20 may be composed of one cup-shaped member covering a breast B. Alternatively, as shown in FIG. 3, each cup 20 may be composed of three pieces: a upper breast holding face part 60 having a strip shape which horizontally covers an upper portion of the breast B; a lower breast holding face part 70 having a substantially spindle shape which horizontally covers a lower portion of the breast B; and a sternum-side breast holding face part 80 having a substantially triangular shape which is adjacent to both of sternum-side edges 62 and 71 of the upper breast holding face part 60 and the lower breast holding face part 70, the sternum-side breast holding face part 80 vertically covering the sternum area. Since these three pieces 60, 70, and 80 have functions different from one another, they may be formed from separate foam textiles. In the embodiment below, a case where separate foam textiles are respectively used as three pieces 60, 70, and 80 will be described.

A foam textile 1 is a foam textile obtained by attaching a cloth 5 to one face of a foamed material 4. Examples of the foamed material 4 are varied and include foamed materials having different expansion ratios, i.e., different hardnesses, and those with a large number of air holes 25 perforated therein at predetermined intervals. For the pieces 60, 70, and 80, appropriate foam textiles 1 are used in accordance with their required characteristics, respectively. Here, first, the foam textiles 1 are cut to provide the upper breast holding face part 60, the lower breast holding face part 70, and the sternum-side breast holding face part 80, respectively. With respect to the sternum-side breast holding face part 80, a rib 80*a* will be formed on the inner face thereof, and thus, a foamed material 4 is used that is thicker or harder having a lower expansion ratio compared with foamed materials 4 used as the upper breast holding face part 60 and the lower breast holding face part 70. Since the upper breast holding face part 60 and the lower breast holding face part 70 serve to wrap the breast B, materials that are soft having high expansion ratios are used for them. For these pieces 60 and 70, the foam textiles 1 having the air holes 25 formed therein are preferably used. If necessary, the foam textile 1 having the air holes 25 formed therein may also be used for the piece 80.

By seaming or bonding together the upper breast holding face part 60, the lower breast holding face part 70, and the sternum-side breast holding face part 80 which have been cut out, a cup textile 2 having a round shape is formed. Each seam line or bonding line forms a concave line by being pulled by a thread or as adhesive. As shown in FIG. 8, the asp textile 2 is fitted in a primary die K1 such that the foamed material 4 faces the female die and the cloth 5 faces the male die, to mold the cup textile 2 into a cup shape. At this time, the rib 80*a* is formed on the inner face of the sternum-side breast holding face part 80. In the molding by the primary die K1, a top-surrounding portion 20*a* around the top of the cup 20, the top being a most-elevated portion in the cup 20, is caused to have a foam density higher than the foam density of an outer periphery portion 20*b* of the cup 20, so as to be a high-stretch portion. At the same time, each of the outer periphery portion 20*b*, in the cup 20, of the sternum-side breast holding face past 80, a lower edge portion 24 of the lower breast holding face part 70, and a strap attachment portion 60*a* of the upper breast holding face part 60 is caused to have a lowest foam density, so as to be a non-stretch portion that is flexible but hardly stretches. Still further, an upper edge portion 61 of the upper breast holding face part 60 is caused to have a foam density higher than the foam density of each non-stretch portion and lower than the foam density of the high-stretch portion, such that the upper edge portion 61 has stretchability that is intermediate between stretchability of the high-stretch portion and stretchability of the non-stretch portion. On a surface of a primary molded article M1 of the cup 20, connected portions (seamed portions or bonded portions) of the three pieces 60, 70, and 80 are exposed. Thus, subsequently, secondary molding is performed as shown in FIG. 9.

In secondary molding, a dressing foam textile 3 is arranged on the female die side and the primary molded article M1 is placed thereon. Then, the foamed material 4 of the dressing foam textile 3 and the foamed material 4 of the primary molded article M1 are pressed to be thermally bonded together over the entirety of their facing surfaces. With respect to a secondary molded article M2 thus formed, the double foamed materials 4 integrally bonded together exist therein, and one cloth 5 that is thin enough to hardly affect the stretchability of the secondary molded article M2 is attached to each of the outer surface and the inner surface of the secondary molded article M2. Due to the dressing foam textile 3 on the outer surface side, the connected portions of the three pieces 60, 70, and 80 are no longer exposed on the outer surface side.

For each cloth 5, a solid or decorated textile (especially for outer surface) may be used. Further, in consideration of production efficiency, the cloth 5 that is, in advance, integrally formed on a surface of a foamed polyurethane textile being the foamed material 4 is appropriately used. It should be noted that the embodiment shown in FIG. 1 shows the brassiere 10 in which an exterior cloth 90 is attached to a surface of the cloth 5, and a lace textile 23 is further added to the outer surface side of the exterior cloth 90 with a bond or the like. If the cloth 5 that is beautiful is used, the exterior cloth 90 can be omitted. In the case above, boundary lines 21*a* and 21*b* among the three types of breast holding face parts 60, 70, and 80 are made to be concave lines on the inner face side of the cup 20, and serve as reinforcing lines with their foam densities set to be smaller than the foam density of the high-stretch portion. Further, the boundary lines 21*a* and 21*b* are caused to have properties partially different from each other, by making foam densities partially different from each other based on the degree of heating and compression during molding. For example, the boundary lines 21*a* and 21*b* having partially different stretchability, flexibility, resilience, non-stretchability, and the like can be formed.

Specifically, the surrounding portion 20*a* around and including the top being a most-elevated portion in the cup 20 is caused to have a foam density higher than the foam density of the outer periphery portion 20*b* of the cup 20, so as to be a high-stretch portion. Then, the outer periphery portion 20*b* of the cup 20: that is, an outer periphery portion of the sternum-side breast holding face part 80 including an inner edge 81; the lower edge portion 24 of the lower breast holding face part 70 including a lower edge thereof; and the strap attachment portion 60*a* which is the underarm-side end portion of the upper breast holding face part 60 and to which the strap 50 is attached, is caused to have a lowest foam density by maximizing the compression rate, to be a non-stretch portion that is flexible but hardly stretches. Further, by setting the compression rate of the upper edge portion 61 of the upper breast holding face part 60 to be medium, the upper edge portion 61 of the upper breast holding face part 60 is caused to have a foam density higher than the foam density of the non-stretch portion and lower than the foam density of the high-stretch portion being the top-surrounding portion 20*a* and its periphery, such that the upper edge portion 61 has stretchability that is intermediate between stretchability of the high-stretch portion and stretchability of the non-stretch portion. It is understood that the foam densities of boundary portions among the non-stretch portion, the intermediate-stretch portion, and the high-stretch portion are adjusted so as to be gradually reduced toward portions having lower stretchability.

More specifically, the stretchability in the horizontal direction of the upper edge portion 61 of the upper breast holding face part 60 (since the upper breast holding face part 60 is long in the horizontal direction and is short in its width in the vertical direction, and needs to fit the upper portion of the breast B, the stretchability in the horizontal direction is especially important) is medium. As described above, the upper edge portion 61 has a medium foam density. Although the portion, of the upper breast holding face part 60, adjacent to the top-surrounding portion 20*a* is formed to be relatively thick so as to have a foam density substantially the same as the foam density of the periphery of the top-surrounding portion 20*a*, by reducing the amount of heating and compression of the foamed polyurethane textile, the upper edge portion 61 has medium stretchability with a reduced foam density. Accordingly, the upper edge portion 61 of the upper breast holding face part 60 has a flexibility that allows the upper edge portion 61 to fit the skin. It should be noted that the compression rate of the upper edge may be set to be as high as that of the non-stretch portion so as to suppress the upper edge from stretching. Accordingly, the breast B can be prevented from protruding out of the upper edge while the above fitting feature is maintained. It is understood that the portion, of the upper breast holding face part 60, adjacent to the top-surrounding portion 20*a* of the lower breast holding face part 70 has high stretchability. Further, since the strap 50 is attached to the underarm-side end portion, the degree of compression of the strap attachment portion 60*a* is increased to make the foam density thereof lowest, thereby making the strap attachment portion 60*a* a non-stretch portion that is flexible but hardly stretches.

The stretchability in each of the vertical direction and the horizontal direction of the top-surrounding portion 20*a* of the lower breast holding face part 70 is as high as that of the aforementioned adjacent portion of the upper breast holding face part 60. Accordingly, the top-surrounding portion 20*a* of the lower breast holding face part 70 is formed relatively thick by reducing the amount of heating and compression of the foamed polyurethane textile. The lower edge portion 24 of the lower breast holding face part 70 is formed by being heated and compressed to have a thickness enough to eliminate the elasticity of the foamed polyurethane textile itself for the entire length thereof.

Since the sternum-side breast holding face part 80 is a portion for supporting the inwardly pushed breast B and for pushing up the breast B, the stretchability thereof is suppressed on the whole and the rib 80*a* having a substantially triangular shape described above is formed in a projecting manner, on substantially the entire inner face of the sternum-side breast holding face part 80. The rib 80*a* has a curved surface that is high in the middle and that is gradually lowered toward the periphery thereof such that the thickness of the rib 80*a* is reduced, and the inner side of the rib 80*a* forms a wall 80*b* that is smoothly curved so as to be slightly concave inwardly. The wall 80*b* extends from the rib 80*a*, over the boundary line 21*b*, to the top-surrounding portion 20*a* of each of the upper and lower breast holding face parts 60 and 70. Further, the inner edge 81 of the sternum-side breast holding face part 80 is outwardly convex curved such that the inner edge 81 lies along the cleavage in the chest (see FIG. 3 and FIG. 5(B)).

When this cup shape (the primary molded article M1) is formed, the boundary portion adjacent to, in the up-down direction, the upper breast holding face part 60 and the lower breast holding face past 70 in the inner face of the cup 20 serves as the boundary line 21*a* in the horizontal direction. Further, the boundary portion adjacent to, in the left-right direction, the sternum-side breast holding face part 80, and both of the sternum-side edges 62 and 71 of the upper breast holding face part 60 and the lower breast holding face part 70 serves as the boundary line 21*b* in the vertical direction. The boundary line 21*a* and the boundary line 21*b* are formed as reinforcing lines, respectively. It should be noted that the reinforcing lines are provided as necessary. Thus, the entirety of an inner face 22 may be formed as a smooth concave hemisphere face without the reinforcing lines.

The coupling tape 30 is for coupling the pair of left and right cups 20 together. In the present embodiment, as the coupling tape 30, a non-stretch coupling tape that is wireless (no wire bone is inserted in the lower edge portion 24 of the cup 20) and that is a thick raised material in a tape shape is employed. By seaming or bonding the coupling tape 30 in a tape shape to the lower edge portion 24 of each of the cups 20, the cups 20 are coupled together. The inner edge 81 of each cup 20 remains free without being seamed or bonded to the coupling tape 30. Specific examples of the raised material used as the coupling tape 30 include velveteen, cotton flannel, velvet, and the like. Here, the reason why a thick raised material is employed as the coupling tape 30 is to increase the strength of the base material of the coupling tape 30 itself so as to stably support the breasts B with the lower portion of the cups 20 although the coupling tape 30 is wireless, and to enhance the good wearing feeling when the coupling tape 30 touches the skin.

Each of the side panels 40 is a strip-shaped member formed from a fiber material having strong stretchability, and one end of each side panel 40 is sewed to the underarm-side end portion of a corresponding cup 20. To a distal end portion of one of the side panels 40, an eye 26 is attached (see FIG. 1), and to a distal end portion of the other of the side panels 40, a hook 27 to be engaged with the eye 26 is attached (see FIG. 2).

The straps 50 are for preventing positional shift of the caps 20 and for lifting and holding the breasts B accommodated in the cups 20. One end of each strap 50 is connected to the underarm-side end portion (the strap attachment portion 60*a*) of the upper breast holding face part 60 of a corresponding cup 20, and the other end of the strap 50 is connected to an upper edge of a corresponding side panel 40 that is located on the back side.

Figure 4:
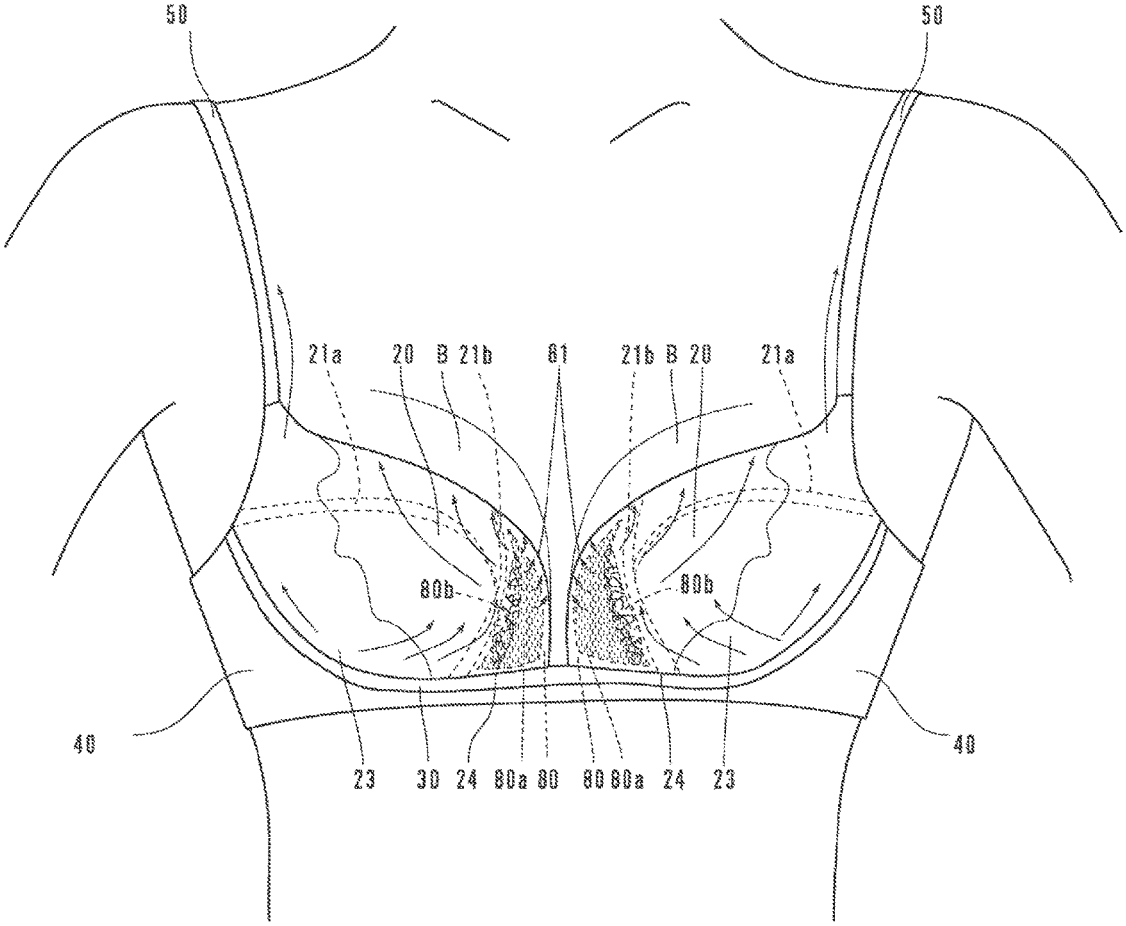
FIG. 4 is a front view showing a use state where the brassiere shown in FIG. 1 is worn.

Next, when wearing the brassiere 10, as shown in FIG. 4, the breasts B and flab from the underarms to the back are pushed toward the sternum side of the cups 20 to be accommodated in the cups 20, and by the pulling-up force of the straps 50, the breasts B are lifted and pushed toward the sternum side.

What is important here is as follows. The breasts B accommodated in the cups 20 and pushed toward the sternum side are pushed up by the walls 80*b* respectively having the inwardly concave curved surfaces which are on the inner sides of the ribs 80*a* of the sternum-side breast holding face parts 80. Accordingly, the breasts B appear more voluminous, and a beautiful cleavage is formed in the sternum area and a decollete that appears more voluminous is formed in the area around the breasts B.

In addition, in a case where the boundary line 21*b* in the vertical direction as a reinforcing line exists, the boundary line 21*b* serves as reinforce against stretch in the vertical direction. Thus, the sternum-side breast holding face part 80 has a greatly-increased wrapping strength against a force in the horizontal direction toward the sternum side, and will come into contact with and wrap the sternum-side face of a breast B with one sheet. Further, the cup 20 which has been molded has a high ability of elastically holding the breast B because the top-surrounding portion 20*a* of each of the upper and lower breast holding face parts 60 and 70 is rich in stretchability in each of the vertical direction and the horizontal direction. Thus, as shown in FIG. 4(B), the cups 20 elastically follow the shape of the breasts B pushed in the horizontal direction, and thus, the breasts B can be easily pushed toward each other. In a case where the boundary line 21*a* in the horizontal direction is formed in each cup 20, this helps adjusting the shape of the breasts B.

Further, since the upper edge portion 61 of the upper breast holding face part 60 is rich in flexibility, even if the upper edge portion 61 abuts against somewhere in a upper round portion or the base of the breast B, the upper edge portion 61 will lie along the skin surface so as to fit it, and does not bite into the skin surface or does not cause unevenness of the skin surface as a result of pressing the skin surface. Accordingly, the upper breast holding face part 60 serves as a contact surface appropriate for the upper round portion of the breast B, and thus, provides good wearing feeling on the upper side of the brassiere 10, and does not cause uncomfortableness between the cup 20 and the skin surface.

Further, the top-surrounding portion 20*a* of the lower breast holding face part 70 is rich in resilience and the lower edge portion 24 thereof is non-stretchable. Thus, as shown in FIG. 4(A), when the lower breast holding face part 70 abuts against a lower portion of the breast B, the lower breast holding face part 70 elastically changes its shape so as to wrap the lower portion of the breast B to stably hold the breast B, and serves as a holding face appropriate for the lower round portion of the breast B.

When wearing the brassiere 10, the cups 20 are pulled up by the pulling-up force of the straps 50, whereby the breasts B are supported. Here, the lower edge portion 24 of the lower breast holding face part 70 is non-stretchable, and the coupling tape 30, which is provided in one piece and connects the cups 20 together, is wireless and non-stretchable, and is attached to and along the lower edge of each cup 20. Thus, the lower edge portions 24 and the coupling tape 30 change their shapes in accordance with the force applied on the cups 20, the force being caused by the breasts B accommodated in the cups 20. Accordingly, the pulling-up force from the straps 50 is applied evenly to the left and right cups 20, whereby a more beautiful bustline can be formed. In addition, since the coupling tape 30 is formed from a thick raised material, the wearer does not feel discomfort as from a conventional metal wire when wearing the brassiere 10.

Further, each cup 20 is configured such that the upper breast holding face part 60 is formed in a narrow strip shape and the upper breast holding face part 60 forms a curved surface with the lower breast holding face part 70, and especially, the outer surface of the cup 20 is covered with the cloth 5. Accordingly, reinforcing lines formed on the inner face 22 side of the cup 20 are not seen from outside. Moreover, another effect can be obtained that even when the wearer wears a garment with a wide neckline, the brassiere 10 and the silhouette of the nipples in the cups 20 are not seen from outside the brassiere 10.

In the above, an example has been described in which: three different types of breast holding face parts 60, 70, and 80 appropriate for pushing the breast B toward the sternum side are put together; the dressing foam textile 3 is overlaid thereon; and the cup 20 of the brassiere 10 is molded. However, the present invention is not limited thereto. The cup textile 2 may be cut out of one sheet of the foam textile 1, and the obtained cup textile 2 may be subjected to molding. In this case, since no seam lines or bonding lines exist, the dressing foam textile 3 can be omitted. Other procedures are the same as those for forming the cup 20 using three pieces.

DESCRIPTION OF THE REFERENCE CHARACTERS

1: foam textile
2: cup textile
3: dressing foam textile
4: foamed material
5: cloth
10: brassiere
20: cup
20*a*: top-surrounding portion
20*b*: outer periphery portion
21*a*, 21*b*: boundary line
22: inner face of cup
23: lace textile
24: lower edge portion
25: air hole
26: eye
27: hook
30: coupling tape
40: side panel
50: strap
60: upper breast holding face part
60*a*: strap attachment portion
61: upper edge portion
62: sternum-side edge
70: lower breast holding face part
71: sternum-side edge
80: sternum-side breast holding face part
80*a*: rib
80*b*: wall
81: inner edge
90: exterior cloth
B: breast
K1: primary die
K2: secondary die
L: reinforcing line
M1: primary molded article
M2: secondary molded article

The invention claimed is:

1. A cup for a brassiere, the cup comprising:

a foam backed fabric molded into a cup shape having a concave inner surface and a convex outer surface, the cup further including an upper breast holding area configured to cover an upper portion of a breast of a wearer, a lower breast holding area configured to cover a lower portion of the breast, and a sternum-side breast holding area configured to cover a sternum-side portion of the breast;

a shoulder strap attached to an underarm-side end portion of the upper breast holding area; and a rib formed on the sternum-side breast holding area.

2. The cup for the brassiere according to claim 1, wherein a peak-surrounding portion of the cup proximate a peak of the convex outer surface of the cup has a first foam density and a first stretchability an outer periphery portion of the cup in the sternum-side breast holding area, a lower edge portion of the lower breast holding area, and a strap attachment portion of the upper breast holding area has a second foam density and a second stretchability, and an upper edge portion of the upper breast holding area has a third foam density higher than the second foam density and lower than the first foam density such that the upper edge portion has a third stretchability that is higher than the second stretchability and lower than the first stretchability.

3. The cup for the brassiere according to claim 1, wherein at least one of the upper breast holding area, the lower breast holding area, and the sternum-side breast holding area has air holes perforated therein, and a first foam used in the sternum-side breast holding area is harder than a second foam used in the upper breast holding area and a third foam used in the lower breast holding area.

4. The cup for the brassiere according to claim 1, wherein boundary lines among the upper breast holding area, the lower breast holding area and the sternum-side breast holding area have concave cross-sections on the concave inner surface of the cup, and are configured to have foam densities lower than the first foam density.

5. A brassiere including cup structured according to claim 1 comprising:

a pair of cups including a left cup and a right cup, wherein each of the left cup and the right cup has a free inner edge configured to be arranged on a sternum side of a breast of a wearer, the left cup and the right cup are coupled together with a coupling tape, along lower edge portions of the cups, side panels respectively extend from underarm-side edges of both cups and are configured to wrap around an underarm portion of the wearer, and a pair of left and right shoulder straps are respectively connected between strap attachment portions of both cups and the side panels.

6. A method for producing a cup for a brassiere, the method comprising:

cutting a foam backed fabric to form a cup textile; and molding the cup textile in a cup shape mold having a convex mold shape to form a cup shape having a concave inner surface and a convex outer surface, and further having an upper breast holding area configured to cover an upper portion of a breast of a wearer, a lower breast holding area configured to cover a lower portion of the breast, and a sternum-side breast holding area configured to cover a sternum-side portion of the breast, wherein during the step of molding a degree of heating and compression is set so that a peak-surrounding portion of the cup proximate a peak of the convex outer surface of the cup has a first foam density and a first stretchability, an outer periphery portion of the cup in the sternum-side breast holding area, a lower edge portion of the lower breast holding area, and a strap attachment portion of the upper breast holding area has a second foam density and a second stretchability, and an upper edge portion of the upper breast holding area has a third foam density higher than the second foam density and lower than the first foam density such that the upper edge portion has a third stretchability that is higher than the second stretchability and lower than the first stretchability, and forming a rib on the sternum-side breast holding area.

7. A method for producing a cup for a brassiere, the method comprising:

cutting a foam backed fabric to separately form a piece for an upper breast holding area of the cup configured to cover an upper portion of a breast of a wearer, a piece for a lower breast holding area configured to cover a lower portion of the breast, and a piece for a sternum-side breast holding area configured to cover a sternum-side portion of the breast;

forming a cup textile by seaming or bonding the pieces together;

subjecting the cup textile to primary molding in a cup shaped mold having a convex mold shape to form a primary molded article, wherein during the step of molding a degree of heating and compression is set so that a peak-surrounding portion of the cup proximate a peak of the convex outer surface of the cup has a first foam density and a first stretchability, an outer periphery portion of the cup in the sternum-side breast holding area, a lower edge portion of the lower breast holding area, and a strap attachment portion of the upper breast holding area has a second foam density and a second stretchability, and an upper edge portion of the upper breast holding area has a third foam density higher than the second foam density and lower than the first foam density such that the upper edge portion has a third stretchability that is higher than the second stretchability and lower than the first stretchability, and forming a rib on the sternum-side breast holding area; and performing secondary molding by arranging a dressing foam backed fabric on an outer surface of the primary molded article, to attach the dressing foam backed fabric to the outer surface of the primary molded article.

8. The cup for the brassiere according to claim 1, wherein the rib is formed on an inner area of the sternum-side breast holding area.

9. The cup for the brasserie according to claim 1, wherein the rib has a triangular shape.

* * * * *